US008119579B2

(12) United States Patent
Habeeb et al.

(10) Patent No.: US 8,119,579 B2
(45) Date of Patent: Feb. 21, 2012

(54) SYNTHETIC LUBRICATING COMPOSITIONS

(75) Inventors: Jacob J. Habeeb, Westfield, NJ (US); Eugine Choi, Marlton, NJ (US); Douglas E. Deckman, Mullica Hill, NJ (US); William H. Buck, West Chester, PA (US); William L. Maxwell, Pilesgrove, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 12/082,385

(22) Filed: Apr. 10, 2008

(65) Prior Publication Data

US 2008/0255010 A1 Oct. 16, 2008

Related U.S. Application Data

(60) Provisional application No. 60/922,656, filed on Apr. 10, 2007.

(51) Int. Cl.
*C10M 175/00* (2006.01)
*C10M 169/04* (2006.01)
*C10G 71/00* (2006.01)

(52) U.S. Cl. ..... 508/111; 508/110; 208/18; 208/19

(58) Field of Classification Search ..... 208/18, 208/19; 508/110, 111
See application file for complete search history.

(56) References Cited

U.S. PATENT DOCUMENTS

| | | | | |
|---|---|---|---|---|
| 4,749,502 | A | 6/1988 | Alexander et al. | |
| 4,956,122 | A | 9/1990 | Watts et al. | |
| 5,208,403 | A | 5/1993 | Buchanan et al. | |
| 6,165,949 | A | 12/2000 | Berlowitz et al. | |
| 6,475,960 | B1 | 11/2002 | Berlowitz et al. | |
| 6,562,230 | B1 | 5/2003 | O'Rear et al. | |
| 6,774,091 | B2 | 8/2004 | Dituro et al. | |
| 6,846,782 | B2 | 1/2005 | Calder | |
| 6,919,300 | B2 | 7/2005 | Dituro et al. | |
| 2002/0137636 | A1 | 9/2002 | Hartley et al. | |
| 2003/0119682 | A1 | 6/2003 | Saini et al. | |
| 2003/0166474 | A1 | 9/2003 | Winemiller et al. | |
| 2003/0166475 | A1 | 9/2003 | Winemiller et al. | |
| 2003/0166476 | A1 | 9/2003 | Winemiller et al. | |
| 2004/0142827 | A1 | 7/2004 | Palazzotto et al. | |
| 2005/0124504 | A1 | 6/2005 | Zhang et al. | |
| 2005/0209109 | A1 | 9/2005 | Winemiller et al. | |
| 2005/0250657 | A1 | 11/2005 | Wu et al. | |
| 2006/0027486 | A1 * | 2/2006 | Rosenbaum et al. | 208/180 |
| 2006/0073991 | A1 * | 4/2006 | Winemiller et al. | 508/192 |
| 2006/0196807 | A1 * | 9/2006 | Rosenbaum et al. | 208/19 |
| 2006/0199743 | A1 * | 9/2006 | Rosenbaum et al. | 508/110 |
| 2007/0142242 | A1 * | 6/2007 | Gleeson et al. | 508/221 |

FOREIGN PATENT DOCUMENTS

| | | | |
|---|---|---|---|
| JP | 10330778 | | 12/1998 |
| WO | WO 00/14187 | | 3/2000 |
| WO | WO 01/79399 | A1 | 10/2001 |
| WO | WO 02/083826 | A1 | 10/2002 |
| WO | WO 2007/050451 | A2 | 5/2007 |
| WO | WO 2007/070691 | A2 | 6/2007 |

* cited by examiner

*Primary Examiner* — Walter D Griffin
*Assistant Examiner* — Vishal Vasisth
(74) *Attorney, Agent, or Firm* — Robert A. Migliorini

(57) ABSTRACT

Lubricating oil compositions of the invention comprise a major amount of a base oil of lubricating viscosity and an effective amount of at least one lubricant antioxidant, the base oil comprising a blend of a Group III base oil derived from a synthesis gas, and a Group IV base oil wherein the ratio of the Group III to Group IV base oils is such that the lubricating composition exhibits an oxidation stability determined by a measure of high temperature deposits that is less than half the mathematical sum of the oxidative stability determined for each of the unblended Group III and Group IV oils containing the same antioxidant in the same amount as in the blend.

5 Claims, No Drawings

SYNTHETIC LUBRICATING COMPOSITIONS

This application claims benefit of Provisional Application 60/922,656 filed Apr. 10, 2007.

FIELD OF THE INVENTION

The present invention relates to lubricating compositions that exhibit enhanced oxidation stability. More particularly, the invention relates to an additized lubricating composition comprising a blend of base oils and at least one antioxidant additive which composition is distinguished by exhibiting an oxidation stability that is greater than that expected based on the oxidation stability of each of the unblended base oils.

BACKGROUND OF THE INVENTION

Lubricating oils for internal combustion engines contain in addition to at least one base lubricating oil, additives which enhance the performance of the oil. A variety of additives, such as detergents, dispersants, friction reducers, viscosity index improvers, antioxidants, corrosion inhibitors, antiwear additives, pour point depressants, seal compatibility additives and antifoam agents, are used in lubricating oils.

Current trends in the design of automotive engines require lubricating oils that have ever more enhanced performance. For example, engines are now designed to operate hotter with higher load and increased output. Such conditions put significant stress on the thermal and oxidative stability of lubricating compositions. To formulate oils that resist oxidation under such conditions and that achieve adequate operation life is both a technical and an economic challenge.

An objective of the present invention is to provide lubricating compositions that have enhanced thermal and oxidative stability.

SUMMARY OF THE INVENTION

Accordingly, the present invention comprises lubricating oil compositions that have an unexpected and surprising oxidative stability evidenced by a measure of high temperature deposits. The compositions comprise:

(1) a major amount of a blend of (a) a Group III lubricating oil derived from a synthesis gas, and (b) a Group IV oil; and (2) an effective amount of at least one antioxidant, wherein the ratio of Group III to Group IV oil is such that the composition exhibits an oxidative stability determined by a measure of high temperature deposits that is less than half the mathematical sum of the oxidative stability of the additized unblended Group III and Group IV oils.

DETAILED DESCRIPTION OF THE INVENTION

The lubricating composition of the invention comprises a major amount of a base oil blend consisting essentially of a Group III oil and a Group IV oil.

In the present application, the term base stock is usually referred to a single oil secured from a single crude source and subjected to a single processing scheme and meeting a particular specification. The term base oils refers to oils prepared from at least one base stock.

The Group III and Group IV oils are specified in the American Petroleum Institute (API) Base Oil Interchangeability Guidelines. The Group III oils are defined as having the following characteristics: 0.03% or less sulfur, 90% or more saturates and a viscosity index of 120 or greater. These oils are typically derived from natural stocks. the Group III oils used in the present invention are prepared from synthesis gas such as in the Fischer-Tropsch (F-T) synthesis process (FT Group III oil).

In an F-T synthesis process, a synthesis gas comprising a mixture of $H_2$ and CO is catalytically converted into hydrocarbons, usually waxy hydrocarbons (referred to as F-T wax) that are generally converted to lower boiling material by process comprising hydroisomerisation and optionally dewaxing. These proces are well known by the person of ordinary skill in the art.

The process of making a lubricant base oil from an F-T wax may include preliminary treatment(s). Treatment to remove any sulfur and nitrogen compounds is not normally needed because F-T waxes have only trace amounts of sulfur or nitrogen. However, F-T waxes may benefit from prehydrotreatment to remove oxygenates.

Particularly favorable processes that can be used for the production of the FT Group III oil are described in U.S. Pat. Nos. 4,594,172; 4,943,672; 6,046,940; 6,475,960; 6,103,099; 6,332,974; and 6,375,830.

F-T base stocks have a beneficial kinematic viscosity advantage over conventional Group II and Group III base stocks and base oils. Such F-T base stocks and base oils can have significantly higher kinematic viscosities, up to about 20-50 $mm^2/s$ at 100° C., whereas by comparison commercial Group II base oils can have kinematic viscosities, up to about 15 $mm^2/s$ at 100° C., and commercial Group III base oils can have kinematic viscosities, up to about 10 $mm^2/s$ at 100° C. The higher kinematic viscosity range of F-T base stocks and base oils, compared to the more limited kinematic viscosity range of Group II and Group III base stocks and base oils, in combination with the instant invention can provide additional beneficial advantages in formulating lubricant compositions.

The F-T Group III oils used in the present invention are characterized as having predominantly paraffinic components and are further characterized as having high saturates levels, low-to-nil sulfur, low-to-nil nitrogen, low-to-nil aromatics, and are essentially water-white in color. The preferred F-T base oils have less than 0.1 wt % aromatic hydrocarbons, less than 20 wppm nitrogen containing compounds, and less than 20 wppm sulfur containing compounds, The FT oils more often have a nominal boiling point of 370° C.$^+$.

The preferred F-T base oils used in the present invention have a pour point of less than −18° C., preferably less than −30° C. They also typically have a combination of dynamic viscosity (DV), as measured by CCS at −40° C., and kinematic viscosity (KV), as measured at 100° C. represented by the formula: DV (at −40° C.)<2900 (KV @ 100° C.)−7000.

A preferred FT oil is one comprising paraffinic hydrocarbon components in which the extent of branching, as measured by the percentage of methyl hydrogens (BI), and the proximity of branching, as measured by the percentage of recurring methylene carbons which are four or more carbons removed from an end group or branch ($CH_2 \geqq 4$), are such that: (a) $BI-0.5(CH_2 \geqq 4)>15$; and (b) $BI+0.85(CH_2 \geqq 4)<45$ as measured over said FT oil as a whole (please check with the technical expert: base oil or base stock. I guess that does not matter as base oil are mixture of FT base stock(s).

The BI is usually ≧25.4. ($CH_2 \geqq 4$) is most often ≦22.5. On average the FT oil has fewer than 10 hexyl or longer branches per 100 carbon atoms and on average have more than 16 methyl branches per 100 carbon atoms.

The preferred FT comprises a mixture of branched paraffins characterized in that the lubricant base oil contains at least 90% of a mixture of branched paraffins, wherein said branched paraffins are paraffins having a carbon chain length of about $C_{20}$ to about $C_{40}$, a molecular weight of about 280 to about 562, a boiling range of about 650° F. to about 1050° F., and wherein said branched paraffins contain up to four alkyl branches and wherein the free carbon index of said branched paraffins is at least about 3.

In the above the Branching Index (BI), Branching Proximity ($CH_2 \geqq 4$), and Free Carbon Index (FCI) are determined as follows:

Branching Index

A 359.88 MHz 1 H solution NMR spectrum is obtained on a Bruker 360 MHz AMX spectrometer using 10% solutions in $CDCl_3$. TMS is the internal chemical shift reference. $CDCl_3$ solvent gives a peak located at 7.28. All spectra are obtained under quantitative conditions using 90 degree pulse (10.9 μs), a pulse delay time of 30 s, which is at least five times the longest hydrogen spin-lattice relaxation time ($T_1$), and 120 scans to ensure good signal-to-noise ratios.

H atom types are defined according to the following regions:

9.2-6.2 ppm hydrogens on aromatic rings;

6.2-4.0 ppm hydrogens on olefinic carbon atoms;

4.0-2.1 ppm benzylic hydrogens at the a-position to aromatic rings;

2.1-1.4 ppm paraffinic CH methine hydrogens;

1.4-1.05 ppm paraffinic $CH_2$ methylene hydrogens;

1.05-0.5 ppm paraffinic $CH_3$ methyl hydrogens.

The branching index (BI) is calculated as the ratio in percent of non-benzylic methyl hydrogens in the range of 0.5 to 1.05 ppm, to the total non-benzylic aliphatic hydrogens in the range of 0.5 to 2.1 ppm.

Branching Proximity ($CH_2 \geqq 4$)

A 90.5 MHz$^3$CMR single pulse and 135 Distortionless Enhancement by Polarization Transfer (DEPT) NMR spectra are obtained on a Brucker 360 MHzAMX spectrometer using 10% solutions in $CDCL_3$. TMS is the internal chemical shift reference. $CDCL_3$ solvent gives a triplet located at 77.23 ppm in the $^{13}C$ spectrum. All single pulse spectra are obtained under quantitative conditions using 45 degree pulses (6.3 μs), a pulse delay time of 60 s, which is at least five times the longest carbon spin-lattice relaxation time ($T_1$), to ensure complete relaxation of the sample, 200 scans to ensure good signal-to-noise ratios, and WALTZ-16 proton decoupling.

The C atom types $CH_3$, $CH_2$, and CH are identified from the 135 DEPT $^{13}C$ NMR experiment. A major $CH_2$ resonance in all $^{13}C$ NMR spectra at ~29.8 ppm is due to equivalent recurring methylene carbons which are four or more removed from an end group or branch (CH2>4). The types of branches are determined based primarily on the $^{13}C$ chemical shifts for the methyl carbon at the end of the branch or the methylene carbon one removed from the methyl on the branch.

Free Carbon Index (FCI). The FCI is expressed in units of carbons, and is a measure of the number of carbons in an isoparaffin that are located at least 5 carbons from a terminal carbon and 4 carbons way from a side chain. Counting the terminal methyl or branch carbon as "one" the carbons in the FCI are the fifth or greater carbons from either a straight chain terminal methyl or from a branch methane carbon. These carbons appear between 29.9 ppm and 29.6 ppm in the carbon-13 spectrum. They are measured as follows:

a. calculate the average carbon number of the molecules in the sample which is accomplished with sufficient accuracy for lubricating oil materials by simply dividing the molecular weight of the sample oil by 14 (the formula weight of $CH_2$);

b. divide the total carbon-13 integral area (chart divisions or area counts) by the average carbon number from step a. to obtain the integral area per carbon in the sample;

c. measure the area between 29.9 ppm and 29.6 ppm in the sample; and d. divide by the integral area per carbon from step b. to obtain FCI.

Branching measurements can be performed using any Fourier Transform NMR spectrometer. Preferably, the measurements are performed using a spectrometer having a magnet of 7.0T or greater. In all cases, after verification by Mass Spectrometry, UV or an NMR survey that aromatic carbons were absent, the spectral width was limited to the saturated carbon region, about 0-80 ppm vs. TMS (tetramethylsilane). Solutions of 15-25 percent by weight in chloroform-d1 were excited by 45 degrees pulses followed by a 0.8 sec acquisition time. In order to minimize non-uniform intensity data, the proton decoupler was gated off during a 10 sec delay prior to the excitation pulse and on during acquisition. Total experiment times ranged from 11-80 minutes. The DEPT and APT sequences were carried out according to literature descriptions with minor deviations described in the Varian or Bruker operating manuals.

DEPT is Distortionless Enhancement by Polarization Transfer. DEPT does not show quaternaries. The DEPT 45 sequence gives a signal for all carbons bonded to protons. DEPT 90 shows CH carbons only. DEPT 135 shows CH and $CH_3$ up and $CH_2$ 180 degrees out of phase (down). APT is Attached Proton Test. It allows all carbons to be seen, but if CH and $CH_3$ are up, then quaternaries and $CH_2$ are down. The sequences are useful in that every branch methyl should have a corresponding CH. And the methyls are clearly identified by chemical shift and phase. The branching properties of each sample are determined by C-13 NMR using the assumption in the calculations that the entire sample is isoparaffinic. Corrections are not made for n-paraffins or cycloparaffins, which may be present in the oil samples in varying amounts. The cycloparaffins content is measured using Field Ionization Mass Spectroscopy (FIMS).

The Group IV oils are defined as polyalphaolefin (PAO) oils. The PAO oils may be derived from monomers having from about 4 to about 30 carbon atoms, and in a preferred embodiment, from about 10 to about 28 carbon atoms. Examples of useful PAOs include those derived from octene, decene, mixtures thereof and the like. These PAOs may have a viscosity of from about 2 to about 15 cSt at 100° C. and preferably from 3 to 12 cSt at 100° C.

In the present invention, the weight ratio of Group III to Group IV base oil may be in the range of from about 80:20 to 20:80, often from 60:40 to 40:60 and preferably 50:50.

The lubricating compositions of the invention are additized, i.e., they include an effective amount of at least one lubricating oil antioxidant additive and more typically an additive package containing at least one antioxidant additive and one or more additives, such as dispersants, detergents, antiwear agents, VI improvers, pour point depressants, defoamants, seal swell control agents, friction modifiers, rust inhibitors and others being optional depending upon the intended use of the oil. Such additive packages often contain a carrier fluid and suitable solubilizers.

Examples of suitable antioxidants include aminic antioxidants and phenolic antioxidants. Typical aminic antioxidants include alkylated aromatic amines, especially those in which the alkyl group contains no more than 14 carbon atoms. Typical phenolic antioxidants include derivatives of dihydroxy aryl compounds in which the hydroxyl groups are in the o- or p-position to each other and which contain alkyl substituents. Mixtures of phenolic and aminic antioxidants also may be used. Such antioxidant(s) may be used in an amount of about 0.02 to 5 wt %, and preferably about 0.1 wt % to about 2 wt % based on the total weight of the composition.

Rust inhibitors selected from the group consisting of nonionic polyoxyalkylene polyols and esters thereof, polyoxyalkylene phenols, and aminic alkyl sulfonic acids may be used.

Corrosion inhibitors that may be used include but are not limited to benzotriazoles, tolyltriazoles and their derivatives.

Suitable dispersants include succinimide dispersants, ester dispersants, ester-amide dispersants, and the like. Preferably, the dispersant is a succinimide dispersant, especially a polybutenyl succinimide. The molecular weight of the polybutenyl group may range from about 800 to about 4000 or more and preferably from about 1300 to about 2500. The dispersant may be head capped or borated or both.

Examples of useful detergents are the alkali and alkaline earth metal salicylates, alkylsalicylates, penates and sulfonates.

A commonly used class of antiwear additives is zinc dialkyldithiophosphates in which the alkyl groups typically have from 3 to about 18 carbon atoms with 3 to 10 carbon atoms being preferred.

Suitable antifoam additives include silicone oils or polysiloxane oils usually used in amounts of from 0.0001 to 0.01 wt % active ingredient. Pour point depressants are well known lubricant additives. Typical examples are dialkylfumarates, polyalkylmethacrylates, and the like.

The number and types of friction modifiers are voluminous. In general, they include metal salts of fatty acids, glycerol esters and alkoxylated fatty amines to mention a few.

Another additive often used in crankcase lubricants is a VI improver such as linear or radial styrene-isoprene VI improvers, olefin copolymers, polymethacrylates, and the like.

In general, on an active ingredient basis, the various lubricant additives will comprise from about 0.5 wt % to about 25 wt % and preferably from about 2 wt % to about 10 wt % based on the total weight of the composition.

In the additized lubricating oil composition of the invention, the weight ratio of the FT Group III oil to the Group IV oil is such that the lubricating composition exhibits an oxidative stability determined by a measure of high temperature deposits when measured by TEOST Test MR T-4 (ASTM D7097) that is less than half of the mathematical sum of oxidative stability determined for each of the Group III and Group IV oils individually when additized with the same additive at the same treat rate.

The additized lubricating composition may, of course, be formulated to have a single viscosity grade such as SAE 30 and preferably be formulated with VI improvers that provide the composition with a multi-viscosity grade including grades 0W20, 5W30 and 10W30 grades.

In one embodiment of the invention, the lubricating compositions comprise a major amount of about equal weight amounts of a Group III oil derived from syngas and a Group IV oil. In this embodiment, the antioxidant-containing additive package is present in an amount whereby the composition has high temperature deposits in the range of about 5 to about 20 when measured by TEOST Test MR T-4 (ASTM D7097).

EXAMPLES

In the following examples, fully formulated lubricating oil compositions were prepared by adding various amounts by weight of one of three adpacks, Adpack A, B or C, to a base oil consisting of 100% of a Group IV oil (a PAO oil), 100% of a Group III oil derived from a F-T process (an F-T oil) and a blend in equal parts by weight of the Group III and Group IV oils (1:1 PAO/F-T oil). Adpack A, B and C all contained effective amounts of antioxidants as well as other lubricant additives including detergents, a ZDDP antiwear additive, a VI improver, a pour point depressant and an antifoam agent. Each of the formulations prepared were tested for oxidation stability by measuring the amount of high temperature deposits formed in the known Thermo-oxidation Engine Oil Simulation Test NH T-4 (TEOST) (ASTM Test Method D7097).

Example 1

Following the general procedure outlined above, nine formulated oils were prepared using Adpak A, and each were subjected to the TEOST test. The amount of adpack used and TEOST results are given in Table 1.

TABLE 1

TEOST Test Results

| | Adpack A Treat Rate, Wt. % | | |
|---|---|---|---|
| Basestock | 10.2 Deposit, mg | 7.65 Deposit, mg | 5.1 Deposit, mg |
| 100% PAO | 4.5 | 18.0 | 41.3 |
| 100% F-T | 2.1 | 18.0 | 32.9 |
| 1:1 PAO/F-T | 3.2 | 6.8 | 19.5 |

The results show that at the three treat levels tested, those using a blend of PAO and F-T oils had TEOST deposits less than half the mathematical average of 100% PAO or 100% F-T at the same treat level. The effect is more pronounced at the lower treat rates employed. This implies significant savings when using the base stock of the invention.

Example 2

The procedure of Example 1 was followed, but Adpack B was used. The amount of adpack used and the test results are given in Table 2.

TABLE 2

TEOST Test Results

| | Adpack B Treat Rate, Wt. % | | |
|---|---|---|---|
| Basestock | 10.2 Deposit, mg | 7.65 Deposit, mg | 5.1 Deposit, mg |
| 100% PAO | 15.7 | 31.2 | 58.4 |
| 100% F-T | 12.4 | 29.0 | 30.9 |
| 1:1 PAO/F-T | 4.2 | 20.3 | 35.1 |

As can be seen, the benefits achieved by the invention are substantial at all three treat rates.

Example 3

The procedure of Example 1 was followed, but Adpack C was used. The amount of adpack used and best results achieved are given in Table 3.

TABLE 3

| TEOST Test Results | | | |
|---|---|---|---|
| | Adpack C Treat Rate, Wt. % | | |
| Basestock | 10.2 Deposit, mg | 7.65 Deposit, mg | 5.1 Deposit, mg |
| 100% PAO | 9.7 | 7.8* | 44.0 |
| 100% F-T | 10.9 | 15.6* | 15.4 |
| 1:1 PAO/F-T | 4.6 | 4.6* | 30.7 |

*Average of three tests

As can be seen, two of the three treat levels produced significant results using a 1:1 PAO/F-T blended base oil.

What is claimed is:

1. A method of formulating a lubricating oil composition comprising a major amount of a base oil of lubricating viscosity and an effective amount of at least one lubricant antioxidant and wherein said base oil consists essentially of a blend of a Group III oil derived from synthesis gas and a Group IV oil, the improvement comprising using a blend of (i) a Group III oil containing at least 90% of a mixture of branched (paraffins having a chain length of about $C_{20}$ to $C_{40}$, a molecular weight of about 280 to about 562 and a pour point of less than −18° C., and (ii) Group IV oils having a Kv from about 2 to about 15 cSt at 100° C., wherein said oils are blended in a ratio such that the lubricating composition exhibits an oxidative stability determined by a measure of high temperature deposits formed in TEOST Test MH T-4 (ASTM D7097) that is less than half the mathematical sum of the oxidative stability determined for each of unblended Group III and Group IV oils containing the same antioxidant in the same amount as in the blend, and wherein the antioxidant is present in an amount in said blend whereby the composition has high temperature deposits of about 5 to 20 when measured by said TOEST Test, thereby providing a lubricating composition with enhanced oxidative stability.

2. A method for improving the oxidative stability of a lubricating composition comprising a blend of a Group III oil derived from synthesis gas and a PAO oil, said blend containing at least one antioxidant selected from phenolic and aminic antioxidants, the method comprising blending base oils consisting of Group III and PAO oils wherein (i) said Group III oil is derived from a Fischer-Tropsch process and contains at least 90% of a mixture of branched paraffins having a chain length of about $C_{20}$ to $C_{40}$, a molecular weight of about 280 to about 562 and a pour point of less than −18° C., and (ii) said PAO has a Kv of from about 2 to about 15 cSt at 100° C., wherein said oils are blended in a ratio such that the lubricating composition exhibits an oxidative stability determined by a measure of high temperature deposits formed in TEOST Test MH T-4 (ASTM D7097) that is less than half the mathematical sum of the oxidative stability determined for each of unblended Group III and PAO oils containing the same antioxidant in the same amount as in the blend, and wherein said antioxidant is present in an amount in said composition such that the composition has high temperature deposits of about 5 to 20 when measured by said TOEST Test.

3. The improvement of claim 1 wherein the antioxidant is present in the range of about 0.02 to 5 wt % based on the total weight of the composition.

4. The improvement of claim 3 wherein the antioxidant is selected from phenolic antioxidants, aminic antioxidants and mixtures thereof.

5. The improvement of claim 4 including in said composition one or more additives selected from dispersants, detergents, antiwear agents, VI improvers, pour point depressants, defoamants, seal swell control agents, friction modifiers and rust inhibitors.

* * * * *